US006164456A

United States Patent [19]

Smucker et al.

[11] Patent Number: 6,164,456

[45] Date of Patent: Dec. 26, 2000

[54] METHOD AND APPARATUS FOR ISOLATION OF TRACE MATERIALS FROM A HETEROGENOUS SAMPLE

[75] Inventors: Alvin J. M. Smucker, Okemos; Jay A. Siegel, Lansing, both of Mich.

[73] Assignee: Board of Trustees operating Michigan State University, East Lansing, Mich.

[21] Appl. No.: 09/267,887

[22] Filed: Mar. 11, 1999

[51] Int. Cl.[7] ..... B03B 5/62; B03D 1/14; B03D 1/24

[52] U.S. Cl. ..... 209/164; 209/168; 209/170; 209/158; 209/159; 209/173; 209/454

[58] Field of Search ..... 209/164, 168, 209/170, 173, 158, 159, 454

[56] References Cited

U.S. PATENT DOCUMENTS

| | | |
|---|---|---|
| 3,298,519 | 1/1967 | Hollingsworth . |
| 4,478,710 | 10/1984 | Smucker et al. . |
| 4,822,493 | 4/1989 | Barbery et al. . |
| 5,191,982 | 3/1993 | Tong . |
| 5,305,888 | 4/1994 | Meylor et al. . |
| 5,307,937 | 5/1994 | Hutwelker . |
| 5,436,384 | 7/1995 | Grant et al. . |
| 5,458,738 | 10/1995 | Chamblee et al. . |

OTHER PUBLICATIONS

Smucker, A.J.M., Soil Environmental modifications of root dynamics and measurement. Annual Review of Phytopathology 31:191–216 (1993).

Smucker, A.J.M., et al., Agronomy Journal 74:500–503 (1982).

*Primary Examiner*—Thomas M. Lithgow

*Attorney, Agent, or Firm*—Ian C. McLeod

[57] ABSTRACT

An elutriation apparatus which combines pressurized liquid nozzles (16A) and the low energy air nozzles (20) producing bubbles for flotation and separation of trace materials in a heterogeneous mixture of materials is described. Quantitative separation of trace evidence is achieved by the apparatus by a closed system of mechanical separations using the water and the air to isolate and deposit trace evidence on a fine mesh screen filter (17) submerged in the water (24) in a container (23). The method provides a rapid, quantitative and inexpensive method for detection of the evidence in soil samples.

16 Claims, 4 Drawing Sheets

METHOD AND APPARATUS FOR ISOLATION OF TRACE MATERIALS FROM A HETEROGENOUS SAMPLE

BACKGROUND OF THE INVENTION (1) Field of the Invention

The present invention relates to an apparatus for detecting trace materials in a heterogenous sample. In particular, the present invention relates to an apparatus which separates trace evidence from a soil sample using jets of water and air bubbles which lift and separate the trace evidence from the soil and deposits the evidence on a fine mesh screen filter.

(2) Description of Related Art

The extraction of trace evidence materials from crime scene soil samples has remained a somewhat neglected area of research in forensic science. Trace evidence may be useful in event reconstruction and in determining the association of people, places, and things. Trace evidence of various forms (e.g. hairs, fibers, glass, and paint) may be associated with various soil materials. This mixture often results from crimes committed in various modes and environments. These methods are generally subjective, time consuming, and relatively inefficient. Furthermore, if trace evidence materials are obscured due to the adherence of soil particles they may be overlooked.

Conventional methods for the isolation of trace evidence from various substrates do exist; however, these techniques are generally limited to the processing of low volume dust samples (garments, and the like), and thus are not implemented specifically for high volume soil samples. The most common techniques implemented for the processing of soil for evidentiary purposes involve manual dry sieving and/or vacuuming, accompanied by visual microscopic observation and forceps removal. The prior art suggests that "hand" picking, which involves the observation and subsequent removal of trace evidence material from various substrates (garments, carpet, dust samples) with forceps, needles or magnets, is the best method of evidence collection (Gaudette, B. D., Forensic Science Handbook 2;209–272 (1988); Palenik, S., Forensic Science Handbook, 2:161–202, Englewood Cliffs, N.J.: Prentice Hall (1988); Saferstein, R., Criminalistics: An Introduction to Forensic Science (5th ed.). Englewood Cliffs, N.J.: Prentice Hall (1995) and Suzuki, E. A., Forensic Science Handbook, 3:24–70, Englewood Cliffs, N.J.: Prentice Hall (1993) suggest that following this initial examination, the material should then be observed under a stereo- binocular microscope, followed by forceps removal of evidentiary items. These methods, however, are extremely tedious, time consuming, and subject to human error, especially in instances of mass disaster and cremation for which trace evidence may be combined with large volumes of soil. Others suggest that trace evidence materials be collected via vacuuming, tape-lifting, shaking, or scraping, followed by microscopic examination and separation of evidence with forceps removal (Bisbing, R. E., Forensic Science Handbook 1:184–221 (1982); Osterberg, J. W., and R. H. Ward, Criminal Investigation: A Method for Reconstructing the Past (5th ed.). Cincinnati, Ohio: Anderson Publishing Co. (1992); Palenik, S., Forensic Science Handbook 2:161–202 (1998); Suzuki, E. A., Forensic Science Handbook 3:24–70 (1993)). However, these methods do not apply generally and are not commonly used for evidence extraction from soil samples alone. Thus, there is a need for a more quantitative and efficient technique.

A hydropneumatic elutriation apparatus has been utilized to extract root materials and other organic soil material from soil samples (U.S. Pat. No. 4,478,710 (1984) to Smucker et al; Smucker, A. J. M., Soil environmental modifications of root dynamics and measurement. *Annual Review of Phytopathology* 31:191–216 (1993); Smucker, A. J. M., et al., Agronomy Journal 74:500–503 (1982)). This apparatus separates materials based on differential density elutriation and has proven to be an efficient quantitative method of root system isolation. Used in conjunction with computer imaging, hydropneumatic elutriation allows precise quantitation of root system components (Smucker, A. J. M., Soil environmental modifications of root dynamics and measurement. *Annual Review of Phytopathology* 31:191–216 (1993)). An apparatus consisting of a battery of eight elutriation columns is commercially available for separating root materials from mineral soils. It was recognized in the patent disclosure that a comparable method could be utilized for the separation of trace evidence materials from soil samples; however, the apparatus was not designed to examine large volumes of soil for the purpose of using materials as evidence.

Other related prior art is set forth in U.S. Pat. No. 4,822,493 to Barbery, et al; U.S. Pat. No. 5,191,982 to Tong; U.S. Pat. No. 5,305,888 to Meylor et al; U.S. Pat. No. 5,307,937 to Hutwelker; U.S. Pat. No. 5,436,384 to Grant et al; and U.S. Pat. No. 5,458,738 to Chamblee et al.

There is a need for a trace evidence separation technique which would allow analysts to process numerous soil samples from a crime scene and quantitatively recover uncontaminated trace evidence from large sample volumes more effectively. Such a method could be successfully implemented and tremendously useful at crime scenes and in situations involving victim burial, explosions, cremations, and mass disasters in which trace evidence items are often combined with very large volumes of surface and/or deeper soil material.

OBJECTS

It is therefore an object of the present invention to provide an improved method and apparatus for separating trace materials from soil samples. It is further an object of the present invention to provide a method and apparatus which is fast and efficient. Further still, it is an object of the present invention to provide an apparatus which is economical to construct and which can be used by relatively technically unskilled personnel. These and other objects will become increasingly apparent from the following description and the drawings.

SUMMARY OF THE INVENTION

The present invention relates to an elutriation apparatus for the separation and classification of a heterogeneous mixture of solids and having components with different specific gravities separable by means of a liquid and air classification comprising a tubular conduit having a vertically oriented longitudinal axis and opposing upper and lower ends along the axis, wherein the lower end is closed; a tubular transfer tube connected to and closing the upper end of the conduit and leading away from the axis of the conduit with an opening from the tube for removing a liquid flowing through the conduit and the tube; air bubble generating means through the lower end of the conduit for providing a stream of air bubbles vertically through the tubular conduit and parallel to the axis and out an air vent hole; nozzle means mounted on the conduit and directed inward at an angle for introducing at least one stream of the liquid inside the tubular conduit adjacent to the air bubble generating means such that the stream of the liquid is directed inwardly around the axis of the tubular conduit; classification means adjacent to the opening from the transfer tube for collecting some of the materials separated from the heterogeneous mixture; a feed column for introducing the heterogeneous mixture of solids into the tubular conduit connected to the tubular conduit intermediate to the ends to feed the material into the streams from air bubble generating means and the nozzle means so that the trace material is separated from the heterogeneous mixture of solids in the classification means.

The present invention also provides a method for detecting trace evidence in a soil sample comprising providing an elutriation apparatus for the separation and classification of a heterogeneous mixture of solids and having components with different specific gravities separable by means of a liquid and air classification comprising a tubular conduit having a vertically oriented longitudinal axis and opposing upper and lower ends along the axis, wherein the lower end is closed; a tubular transfer tube connected to and closing the upper end of the conduit and leading away from the axis of the conduit with an opening from the tube for removing a liquid flowing through the conduit and the tube; air bubble generating means through the lower end of the conduit for providing a stream of air bubbles vertically through the tubular conduit and parallel to the axis and out an air vent hole; nozzle means mounted on the conduit and directed inward at an angle for introducing at least one stream of the liquid inside the tubular conduit adjacent to the air bubble generating means such that the stream of liquid is directed inwardly around the axis of the tubular conduit; classification means adjacent to the opening from the transfer tube for collecting some of the materials separated from the heterogeneous mixture; and A feed column for introducing the heterogeneous mixture of solids into the tubular conduit connected to the tubular conduit intermediate the ends to feed the material into the streams from air bubble generating means and the nozzle means so that the trace material is separated from the heterogeneous mixture of solids in the classification means, wherein the apparatus is supplied with the air and the water; introducing a soil sample suspected of containing the trace evidence into the feed column so that the air and water in the tubular conduit conveys the trace evidence to the classification means; and accumulating the trace evidence in the classification means.

The particular problem solved by the present invention is the introduction of the heterogeneous mixture of solids into the tubular column so that the trace materials can be separated. The invention provides an improved continuous hydropneumatic evidence elutriation apparatus for separating trace evidence from mineral soil materials which is an improvement over the apparatus described in U.S. Pat. No. 4,478,710. The improved method and apparatus combines the elutriative separation of trace evidence, contained in soil samples, with a sieving process which accumulates the trace evidence. Combinations of a high energy water vortex, air dispersion, water elutriation, and low energy separation and concentration by sieving separate lighter evidentiary materials from heavier mineral soil fractions. The system is based on the principle that materials having densities less than that of the surrounding soil particles are successfully separated and elutriated to a sieve. Soil samples are continuously fed through the feed conduit until accumulated soil sediments interfere with maximum trace evidence separation.

DESCRIPTION OF PREFERRED EMBODIMENTS

The following Examples 1 and 2 describe a single elutriation apparatus and its use as shown in FIGS. 1 to 7.

EXAMPLE 1

Figure 1:
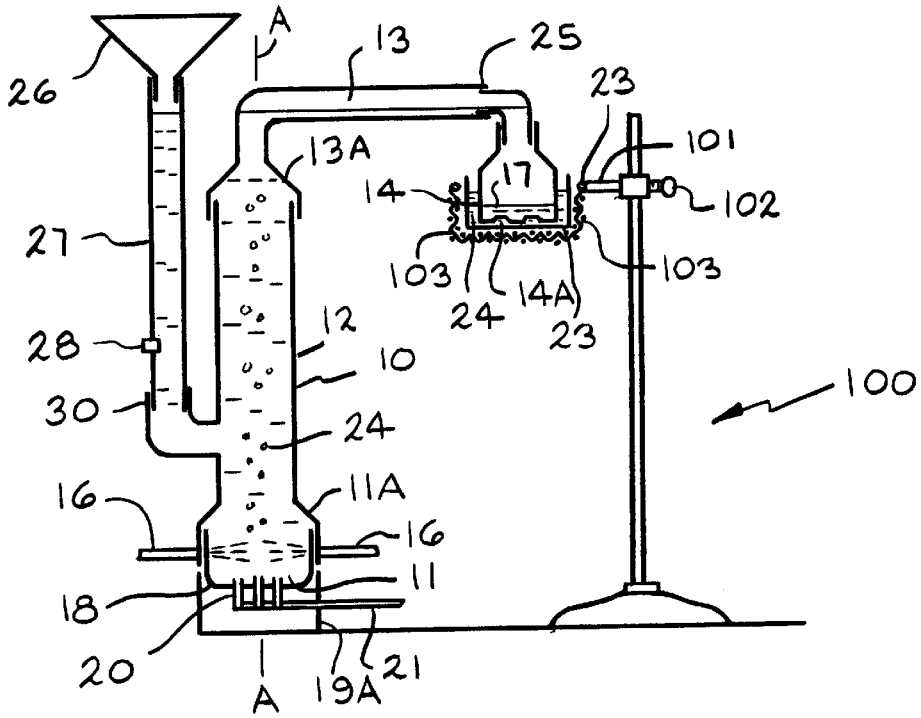
FIG. 1 is a schematic representation of the elutriation apparatus.
Figure 3:
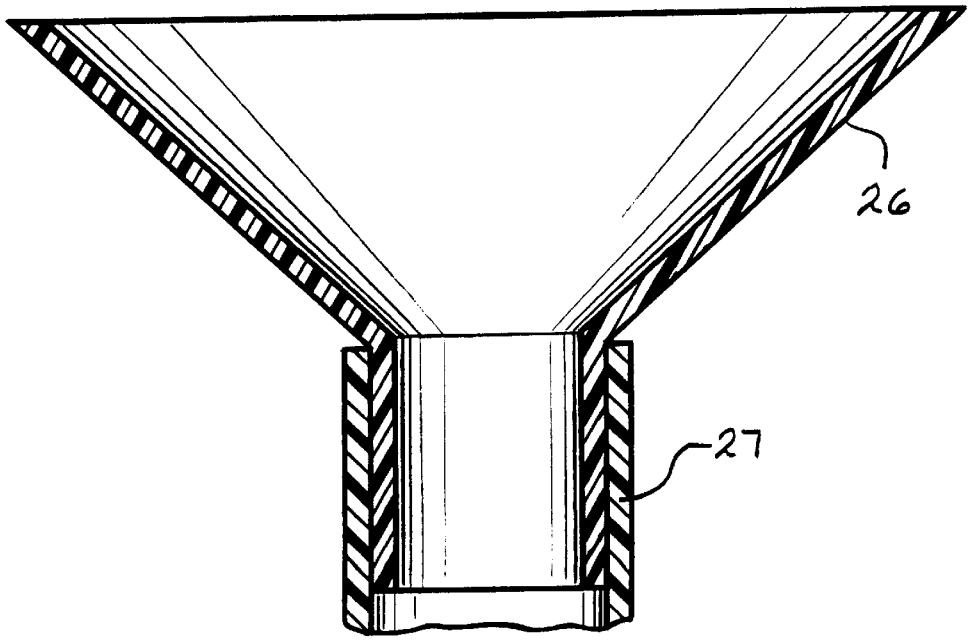
FIG. 3 is an enlarged view of the funnel 26 used for the continuous feed of heterogenous material into the elutriation apparatus.
Figure 2:
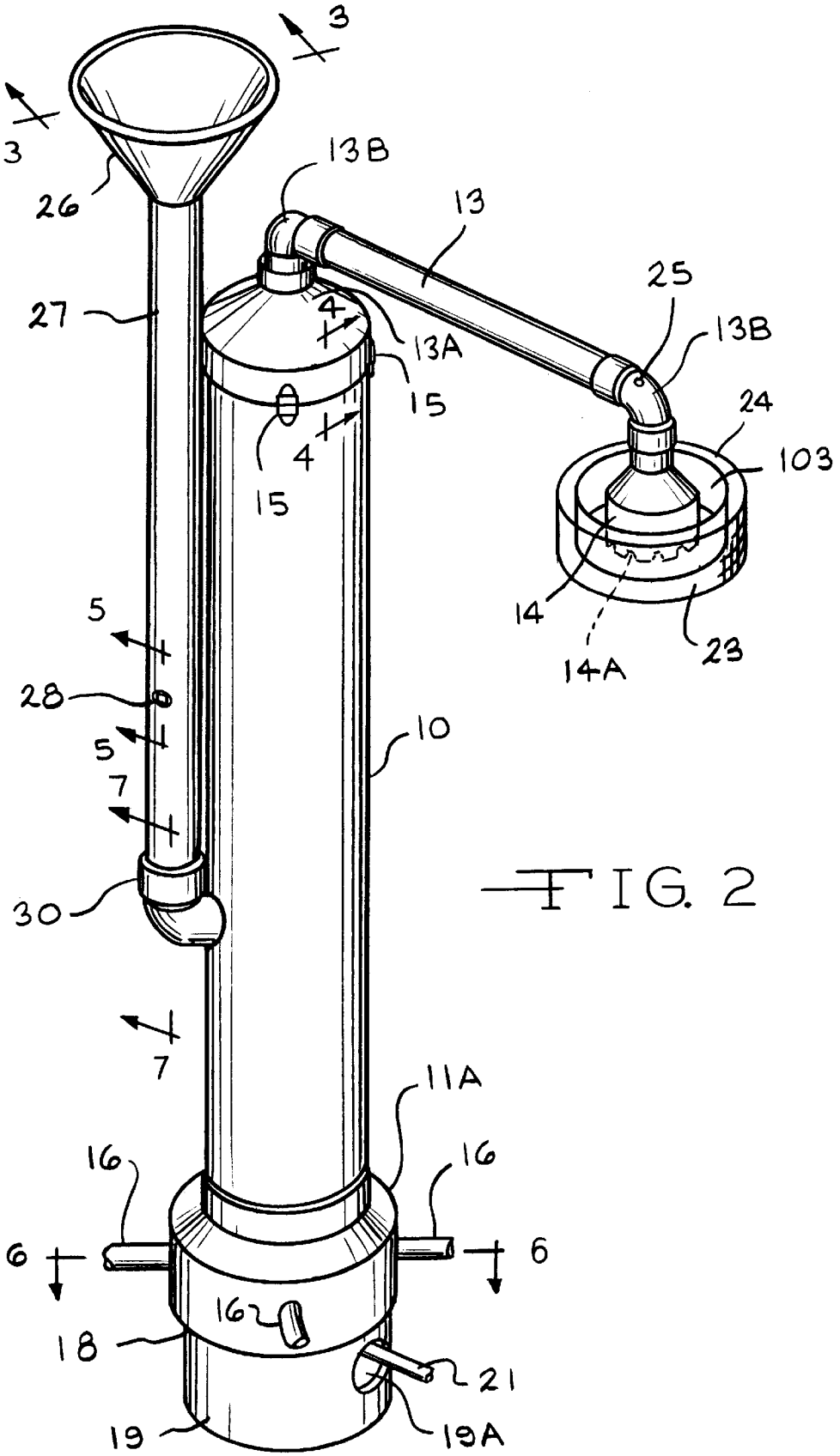
FIG. 2 is an enlarged detailed perspective view of the elutriation apparatus represented in FIG. 1.

The hydropneumatic elutriation (hydroelute) apparatus of the present invention (referred to as the Trace Evidence Concentrator or "TEC") preferably consists of washing chamber 11 and elutriation chamber 12 in conduit 10, a transfer tube 13, and expander 14 with removable and replaceable fine mesh screen filters 17 of variable mesh sizes, as shown in FIG. 1. Each unit was constructed of conventional polyvinyl chloride (PVC) drainage pipe, couplers, and reducers (PVC welded together at selected joints by PVC glue (not shown)). The washing chamber 11 and conduit 10 were constructed by attaching a reducer 11A plugged at the bottom by a cap 18 to the elutriation chamber 12 portion of the conduit 10. The transfer tube 13 consisted of one reducer 13A and elbows 13B (FIG. 2). The reducer 13A was removably connected to the conduit 10 and was removably connected to an expander sieve 14 mounted on the screen support 17. In the examples a fine teflon screen 17 (840 $\mu$m) was clamped into the large opening of expander 14 (FIG. 1). The 840 $\mu$m fine mesh screen filter 17 was easily replaced by screens of different size depending upon the trace material being collected. A base 19 was mounted on cap 18 to allow the apparatus to be mounted on a flat surface (FIG. 1). An opening 19A was provided in base 19 for an air tube 21.

Figure 6:
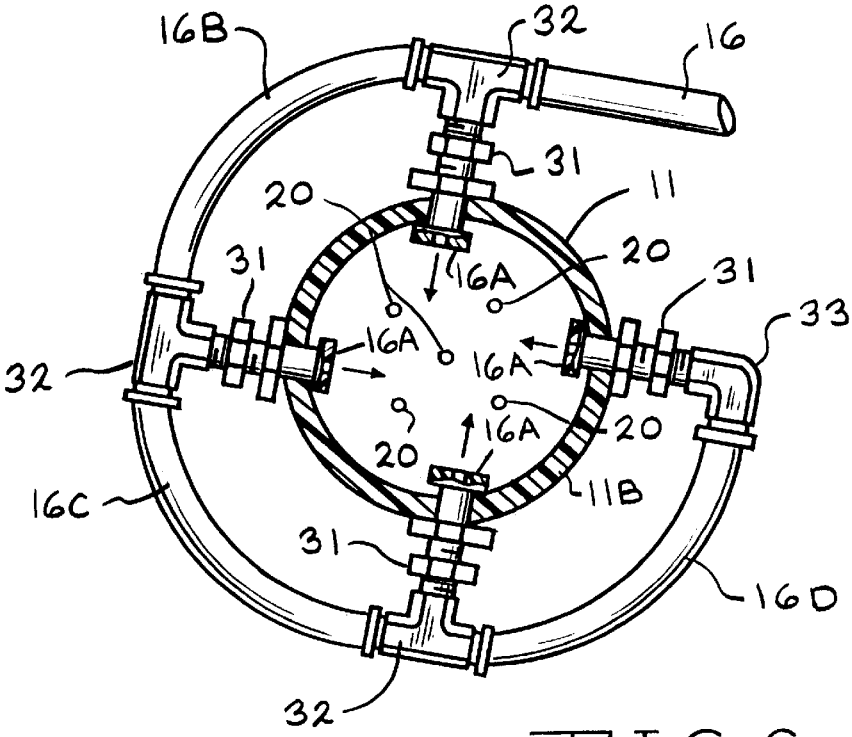
FIG. 6 is a plan cross-sectional view along line 6—6 of FIG. 2 showing the position of the water jets 16A.
Figure 7:
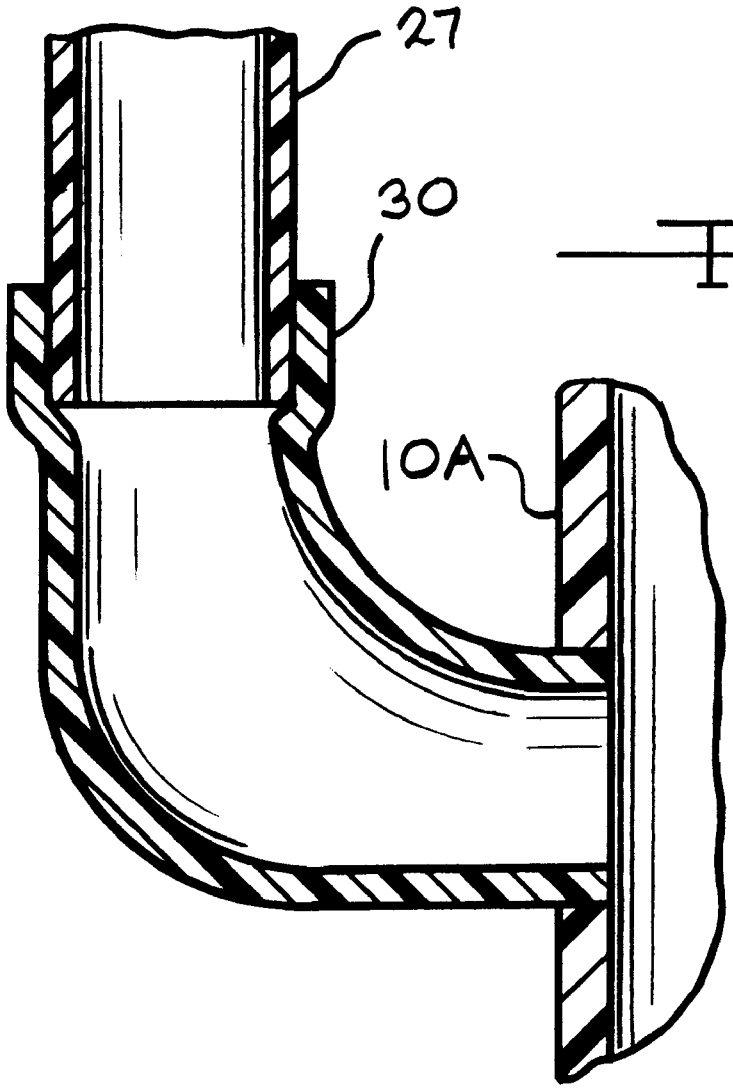
FIG. 7 is a front cross-sectional view along line 7—7 of FIG. 2 showing the continuous feed column 27.

As shown in FIG. 6, four liquid nozzles 16A were supplied by tube 16 were permanently installed, at 90° spacings, through the wall 11B of the washing chamber 11 formed by the cap 18 for creating a high energy vortex (arrows—FIG. 6). The liquid nozzles 16A were preferably directed at an angle about 10 degrees from the axis A—A of FIG. 1 measured in a horizontal plane. The liquid nozzles 16A had a circular opening for creating a high kinetic energy vortex in a circular direction around the axis A—A of the conduit 10. Five (5) air nozzles 20 from line 21 were centered at and around the axis A—A in the cap 18 of the chamber 11. The air nozzles 20 were round and had a diameter of 0.035 cm. Conventional removable couplings 31 were provided so that the connections to the liquid nozzles 16A could be removed without disturbing the liquid nozzles 16A in the wall 11B. T's 32 and elbow 33 connect high pressure hose segments 16B, 16C and 16D so that water tube 16 supplies all of the nozzles 16A in parallel.

The high energy hydrovortex created by the liquid nozzles 16A caused soil to be eroded from the trace materials. Small air bubbles 24, FIG. 1, assisted in removing, by flotation, the trace materials from the coarse mineral debris which remained at the cap 18 of the washing chamber 11. Variable inlet pressures of both the air and water from air nozzles 20 and liquid nozzles 16A provided the apparatus with the required energy to wash and separate the fine trace materials from the coarse mineral fractions. Trace materials were separated by a fine mesh screen filter 17. Air was removed through air vent hole 25 in transfer tube 13.

Trace evidence materials were separated from soil samples utilizing the hydropneumatic elutriation apparatus. Recovery efficiencies were those of conventional manual dry sieving and visual examination methods. System efficiencies were based upon the quantities of trace evidence recoveries and sample processing times.

Figure 4:
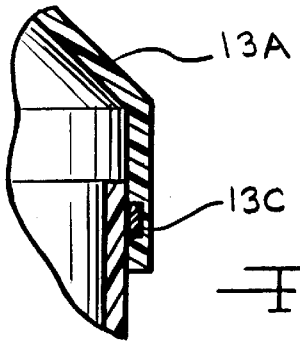
FIG. 4 is an enlarged partial cross-sectional view of the reducer 13A showing a seal 13C.
Figure 5:
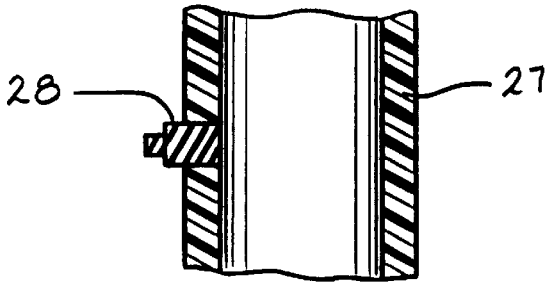
FIG. 5 is a front cross-sectional view along line 5—5 of FIG. 2 of the feed conduit 27 with a drain plug 28.

The PVC components were sealed together using PVC glue or silicone sealant. The elutriation apparatus was constructed by sealing a 16.9 (i.d.)×8.5 cm cap 18 to the 15.3 (i.d.)×45.7 cm conduit 10, with a wall thickness of 0.8 cm. The four sprayer nozzles or water jets 16A (type, T-jet 8003 modified to have a 0.1 cm diameter circular opening in a plate soldered to the nozzle) were installed around the circumference and through the wall 11B at an approximate acute angle of 80 degrees from a front face of the nozzles 16A. In order to lift the cleaned particles of trace evidence to the surface of the conduit 10, the five air nozzles 20 were installed through the bottom of the cap 18, with four equally spaced around its perimeter and one nozzle 20 in the center along axis A—A. The conduit 10 was covered with PVC reducer 13A with an inside diameter of 16.9 to 4.7 cm, combined with a reducing collar with an inside diameter of 6.1 to 4.7 cm. The reducer 13A was equipped with four clamps 15 to eliminate leakage. A rubber o-ring seal 13C was provided in reducer 13 (FIG. 4). The transfer tube 13, elbows 13B and expander 14 consisted of two 4.6 cm couplers, a 3.8×18.0 cm PVC tube (FIGS. 1 and 2), and a submerged fine mesh screen filter 17, with the small air vent hole 25 (0.3 cm) drilled at the top of the transfer tube. The expander had openings 14A. The fine mesh screen filter 17 with apertures of 0.0840 mm, was submerged in a water bath in the container 23 to a depth of 1 cm above the fine mesh screen filter 17. To accommodate large soil samples and to facilitate multiple introductions of samples into the TEC apparatus, the continuous feed column 27 was installed through the wall 10A of the elutriator tube and consisted of a 3.8 cm (i.d.) elbow 30 and a 38 (i.d.)×62.8 cm PVC feed column 27. A small hole was drilled in the side wall of the feed column 27 and plugged with the drain plug 28, to initiate drainage of the elutriation chamber before removing the reducer 13A from the conduit 10 between runs. The funnel 26 (FIG. 3) was removable from column 27 to allow air to be introduced into the column 27 to flush out any remaining trace materials after each run.

A ring stand 100 (FIG. 1) was provided with a ring clamp 101 held in place on stand 100 by a threaded screw 102. The ring clamp 101 supported a coarse mesh screen 103. The container 23 contained water 24 into which the large end of the expander 14 and fine mesh screen filter 17 were submerged.

I. TEC assembly and sample addition.

a) Secure water tube with metal connector b) Secure air tube with plastic connector c) Turn on and adjust air to approximately 10 psi d) Place drain plug 28 in continuous feed column 27 e) Place transfer tube 13 into expander 14 f) Place reducer 13A onto conduit 10 with clamps 15.

g) Place fine mesh screen filter 17 into water in container 24 h) Turn water on and adjust water to 40 psi i) Allow TEC to operate to equilibrium j) Measure 450 g of soil sample k) Add three 150 g portions at 30 second intervals l) Repeat i–k until washing chamber is filled with soil minerals debris m) Rinse continuous feed column 27 with water for 10 seconds n) Allow to elutriate for 10–12 minutes following last 150 g portion.

II. TEC disassembly a) Following 10–12 minute elutriation period remove fine mesh screen filter 17 and expander combination 14 b) Flush continuous feed column 27 for 5–10 seconds with air, catch water in a beaker, and repeat c) Adjust water to 10 psi and remove drain plug 28 from continuous feed column d) Pour beaker contents into submerged fine mesh screen filter 17 in expander 14 and rinse beaker thoroughly e) Rinse screen into white tray (not shown)

f) Remove drain plug 28 in feed column 27 and allow to drain g) Remove TEC reducer 13A h) Adjust water to 40 psi and pouring in base 18 of elutriation apparatus into metal sieve j) Return to I d) above and continue with next sample.

In order to evaluate trace evidence recovery by the TEC apparatus it was necessary to determine maximum and minimum air and water pressures required to elutriate trace evidence materials without eluting coarse sand and silt particles onto the fine mesh screen filter 17. Soil samples without trace evidence were elutriated to determine the maximum pressures. Trace evidence materials, including human hairs, automobile paint chips, and carpet fibers, were then run through the TEC without soil materials, to determine the minimum pressures necessary to elutriate evidentiary items alone. Preliminary testing revealed that optimum air and water pressures were measured at 10 and 40 psi, respectively, for the most effective separation and deposition of trace evidence on the fine mesh screen filter 17.

Preliminary experimentation was also performed to determine the basic effectiveness, known as percent recovery, for composite soil samples and standards of trace evidence from different soil types. Composite samples consisted of 150 g of soil combined with 10 items each of human hair, automobile paint chips, and carpet fibers. Four 150 g soil subsamples were obtained from three different soil types including Tappan clay loam, Kalamazoo loam, and Parkhill loam. Four replications of dried samples were performed for each soil type, for a total of twelve replications. Initially, each 150 g sample was exposed to the elutriation system for 15 minutes; however, during the course of sample processing it was discovered that elutriation time could be decreased to 10 minutes with the addition of a second air source employed to flush out the continuous feed column.

Trace Evidence from Soil at a Simulated Crime Scene

The protocol for determining the efficiency of quantitative separation of trace evidence from soil by the TEC compared to that of a conventional manual dry sieving and visual examination method required a completely randomized block experimental design, with three double-blind treatments having four replications. A simulated crime scene was established first by filling twelve 38.1×50.8×12.7 cm plastic containers, referred to as experimental units, with approximately 6.5 cm soil. The coarse textured soil, contained some aggregated clay and a considerable amount of plant residue. Variable numbers of trace evidence, including human hairs, automobile paint chips, and carpet fibers were uniformly distributed within eight of the experimental units, by an individual who was not the TEC operator. Controls, or soils without trace evidence were randomly selected from four of the twelve experimental units. Soils from eight experimental units (four with trace evidence and four without) were subjected to the TEC system. Four experimental units (containing trace evidence) were processed by the conventional manual dry sieving and visual examination method.

Operation of the TEC apparatus involves, securing the air 21 and water tubes 16 to the appropriate fixtures. Air flow was initiated and adjusted to approximately 10 psi before the water was turned on. The reducer 13A, transfer tube 13, and expander 14 were then secured and the water pressure set to 40–45 psi. The elutriation chamber 12 was filled and the expander 14 submerged in at least 1 cm of water in container 23. A sample of approximately 450 g of soil was poured into a funnel 26 attached to the continuous feed column 27 in three subsamples of 150 g at 30 second intervals. The continuous feed column 27 was flushed with water for 10 seconds and the TEC was run for 10 minutes. Following the 10 minute elutriation period, the TEC was flushed, drained, disassembled, and emptied. This process involves removing the expander 14 and flushing the continuous feed column 27 twice with air, forcing excess water into a container below the transfer tube 13. The extruded water was subsequently emptied into the submerged fine mesh screen filter. The water flow was discontinued. The drain plug 28 was removed from the lower end of the continuous feed column 27 for drainage. Following drainage, the reducer 13A at the top of the elutriation chamber was removed and the sediment in chamber 12 and chamber 11 emptied into a large metal sieve (not shown). The contents of the fine mesh screen filter 17 were washed into a white tray and floated in water for visual examination. While inverted the water pressure was turned on to wash all residues from elutriation chamber 12. Repeat these procedures for the remainder of the soil samples, and ensure adequate rinsing of all TEC components between sample containers to collect any trapped trace evidence. Total time for sample processing and total trace evidence recovery was recorded.

Visual examination of the fine mesh screen filter 17 contents involved the use of a high-powered illuminated magnifier. Visual examination occurred during the ten minute elutriation period. The white tray was placed under the magnifier and scanned for trace evidence. The organic sediment was dispersed, floated, and permitted to settle at least five (5) times in order to facilitate the observance of trace evidence. Any trace evidence observed was subsequently removed with forceps and stored.

Preliminary experimentation revealed that the TEC apparatus was highly effective in elutriating trace evidence particles from three different soil types. The total evidence recovery values from Tappan Clay Loam, Kalamazoo Loam, and Parkhill Loam for human hair, automobile paint chips, and carpet fibers ranged from 93–100%. Individual means and standard deviations are presented in Table 1.

TABLE 1

Trace evidence recovery from three soil types by the TEC (12 replications in total).

| Soil Type | Human Hair % | Paint Chips % | Carpet Fibers % |
|---|---|---|---|
| Tappan Clay Loam (n = 4) | 98(±8)* | 100(±0) | 93(±15) |
| Kalamazoo Loam (n = 4) | 100(±0) | 95(±10) | 100(±0) |
| Parkhill Loam (n − 4) | 100(±0) | 100(±0) | 100(±0) |

*Values in ( ) are standard deviations of the average percentage.

On occasion paint chips were retrieved from the bottom of the elutriation chamber. That is, because some paint chips were comprised of several layers, increasing their density, they tended to remain with the coarse mineral fraction. However, these items were thoroughly cleaned and easily separated from this heavier fraction following the elutriation period. Similarly, other higher density trace evidence items such as glass fragments and rubber pieces could be recovered from the coarse mineral fraction, but none of these items were generally deposited on the fine mesh screen filter 17.

EXAMPLE 2

Simulated crime scene results indicate that both the TEC and manual dry sieving were effective quantitative isolation techniques from trace evidence combined with large quantities of soil. To aid in the efficiency comparison between these two separation systems it was necessary to determine means and standard deviations for air-dry weight values of simulated crime scene soil experimental units (Table 2).

TABLE 2

Air-dry weights of soil samples from experimental units of the simulated crime scene.

| Soil Condition | TEC Elutriated Samples (g) | Sieved Samples (g) |
|---|---|---|
| Blank Control | 5173.1 (±315.31) (n = 4) | N/A |
| Trace Evidence | 5177.9 (±283.25) (n = 3) | 4986.5 (±374.77) (n = 4) |
| Combined | 5174.8 (±268.38) (n = 7) | N/A |

The method of evidence concentration using the TEC apparatus proved to be an effective, efficient, and quantitative technique for trace evidence separation. Total recovery results from human hairs, automobile paint chips, and carpet fibers were 86%, 87%, and 100%, respectively. Means and standard deviations are presented in Table 3.

Table 3 also depicts the total trace evidence recovery results for the manual dry sieving method. Similarly, this technique proved to be very effective. Total recovery results for human hairs, paint chips, and carpet fibers were 92%, 100% and 100%, respectively.

TABLE 3

| Soil | Trace evidence recovery from experimental units of the simulated crime scene. | | | |
|---|---|---|---|---|
| | TEC Elutriation | | Manual Sieving | |
| Condition | X/Y* | % | X/Y* | % |
| Blank Control (n = 4) | 0/0(±0) | 0/0(±0) | N/A | N/A |
| Trace Evidence | | | | |
| Human Hairs | 7/7, 4/7, 1/1 | 86(±3) (n = 3) | 19/20, 9/10, 11/12 | 92(±3) (n = 3) |
| Paint Chips | 17/22, 10/10, 9/13, 5/5 | 87(±15) (n = 4) | 11/11, 0/0, 7/7, 2/2 | 100(±0) (n = 4) |
| Carpet Fibers | 9/9, 11/11, 14/14 | 100(±0) (n = 3) | 13/13, 3/3, 26/26, 3/3 | 100(±0) (n = 4) |

*X Number of items recovered
*Y Number of items in sample acquired from experiment director, following separation work.

Trace evidence recovered by both the TEC and manual sieving methods were not significantly different, Table 3. However, the time required to process each kilogram of soil with the TEC was 34.1(±1.0) minutes and with the manual sieving method was 41.1(±1.3) minutes. Thus, the TEC was an average of 21% faster than the manual sieving method for processing experimental units.

The TEC is designed for the potential of operating collectively with several other units. In order to most efficiently pass large volumes of high organic content soil, a manifold of TEC elutriation chambers and associated submerged fine mesh screen filters 17 could be employed. Such a combination of several TEC systems would effectively prevent organic content from accumulating on the fine mesh screen filter 17 and obscuring trace evidence and facilitate trace evidence removal from the fine mesh screen filter 17.

With regard to overall time efficiency, the TEC apparatus is definitely superior. The manual dry sieving and visual examination required an average of 21% longer per kilogram of soil processed than did the TEC. This difference is significant especially for incidents such as explosions, arsons, and the like in which hundreds of kilograms of soil may require processing in order to locate important trace items. Although the TEC apparatus is not designed to recover insoluble or soluble chemicals that are not present in an aggregated form, it can be implemented after chemical analyses in order to recover solid incendiaries associated with such incidents.

In summary, the TEC apparatus is useful for crime scene investigators faced with the challenge of isolating trace evidence from both small and large soil sample volumes. The effectiveness of the TEC apparatus has been clearly demonstrated by the research conducted. The results reveal that the TEC method provides a quantitative, user-friendly approach to trace evidence isolation from soil samples. Furthermore, it is important to recognize that the use of the TEC apparatus is not limited to trace evidence, but is designed to accommodate any further modifications, additions, and/or adaptations that may be required for the separation of any other desired trace materials of interest. That is, the TEC system is not limited to utilization for trace evidence recovery, but may be adapted and implemented to isolate trace materials associated with other disciplines such as anthropology, archeology, and the like.

It is intended that the foregoing description be only illustrative of the present invention and that the present invention be limited only by the hereinafter appended claims.

We claim:

1. An elutriation apparatus for the separation and classification of a trace material in a volume of heterogeneous mixture of solids and having components with different specific gravities separable by means of a liquid and air classification comprising:

(a) a tubular conduit having a vertically oriented longitudinal axis and opposing upper and lower ends along the axis, wherein the lower end is closed;

(b) a tubular transfer tube connected to and closing the upper end of the conduit and leading away from the axis of the conduit with an opening from the tube for removing a liquid flowing through the conduit and the tube;

(c) air bubble generating means through the lower end of the conduit for providing a stream of air bubbles vertically through the tubular conduit and parallel to the axis and out an air vent hole;

(d) nozzle means mounted on the conduit and directed inward at an angle for introducing at least one stream of the liquid inside the tubular conduit adjacent to the air bubble generating means such that the stream of liquid is directed inwardly around the axis of the tubular conduit;

(e) classification means adjacent to the opening from the transfer tube for collecting some of the trace material separated from the heterogeneous mixture;

(f) a feed column for introducing the heterogeneous mixture of solids into the tubular conduit connected to the tubular conduit intermediate the ends to feed the trace material with the heterogeneous mixture of solids into the streams from the air bubble generating means and the nozzle means at a rate so that the trace material is separated from the heterogeneous mixture of solids in the classification means, wherein in use after flushing the apparatus with water to remove any trace material in the feed column, a drain plug in the feed column is removed to reduce the water in the tubular conduit and then the tubular column is emptied of the solids.

2. The apparatus of claim 1 wherein the transfer tube has a longitudinal portion perpendicular to the axis of the conduit and a vertical portion positioned such that the opening is downwardly directed along a second axis which is parallel to the axis of the conduit and wherein the lower end of the conduit is wider than the upper end.

3. The apparatus of claim 1 wherein the classification means is a submerged fine mesh screen filter over the opening with an appropriate mesh size for retaining the trace material and wherein a container is provided to immerse the screen in the classification liquid during classification.

4. The apparatus of claim 1 wherein the conduit is supported by a frame, is separable from the transfer tube.

5. The apparatus of claim 4 wherein multiple of the conduit are supported by the frame.

6. The apparatus of claim 1 wherein the feed column is provided with a funnel mounted at an opening in the feed column.

7. In a method for the separation and classification of a heterogeneous mixture of solids having different specific gravities containing a trace material separable by means of a liquid and air classification which comprises:

(a) providing an elutriation apparatus including a tubular conduit having a vertically oriented longitudinal axis and opposing upper and lower ends along the axis, wherein the lower end is closed;

a tubular transfer tube connected to and closing the upper end of the conduit and leading away from the axis of the conduit with an opening from the tube for removing a liquid flowing through the conduit and the tube;

air bubble generating means through the lower end of the conduit for providing a stream of air bubbles vertically through the conduit and parallel with the axis and out an air vent hole;

nozzle means mounted on the conduit and directed inwardly at an angle for introducing at least one stream of the liquid inside the tubular conduit adjacent to the air bubble generating means such that the stream is directed inwardly around the axis of the conduit;

classification means adjacent to the opening from the tube for collecting the trace material separated from the heterogeneous mixture; and a feed column for introducing the heterogeneous mixture of solids containing the trace material into the tubular conduit connected to the tubular conduit intermediate the ends to feed the material into the streams from air bubble generating means and the liquid nozzle means so that the trace material is separated from the heterogeneous mixture of solids in the classification means;

(b) placing a supply of said heterogeneous mixture in the tubular conduit through the feed column;

(c) elutriating trace material by introducing air bubbles through the lower end of the tubular conduit flowing the liquid through the nozzles through the conduit and transfer tube and into the classification means and collecting the remains of the solids in the lower end of the conduit;

(d) collecting the trace material from the classification means;

(e) flushing the feed column with water after introducing the heterogeneous mixture to remove trace material in the feed column; and (f) separating the solids from the lower end of the conduit and removing any trace [materials] material remaining in the solids.

8. The method of claim 7 wherein the trace material is in a soil sample at a crime scene.

9. The method of claim 7 wherein the feed column has a funnel.

10. A method for detecting trace evidence from a crime scene in a soil sample which comprises:

(a) providing an apparatus which comprises:

an elutriation apparatus for the separation and classification of a heterogeneous mixture of solids and having components with different specific gravities separable by means of a liquid and air classification comprising:

a tubular conduit having a vertically oriented longitudinal axis and opposing upper and lower ends along the axis, wherein the lower end is closed;

a tubular transfer tube connected to and closing the upper end of the conduit and leading away from the axis of the conduit with an opening from the tube for removing a liquid flowing through the conduit and the tube;

air bubble generating means through the lower end of the conduit for providing a stream of air bubbles vertically through the tubular conduit and parallel to the axis and out an air vent hole;

nozzle means mounted on the conduit and directed inward at an angle for introducing at least one stream of the liquid inside the tubular conduit adjacent to the air bubble generating means such that the stream of liquid is directed inwardly around the axis of the tubular conduit;

classification means adjacent to the opening from the transfer tube for collecting some of the materials separated from the heterogeneous mixture; and a feed column for introducing the heterogeneous mixture of solids suspected of containing the trace evidence into the tubular conduit connected to the tubular conduit intermediate the ends to feed the material into the streams from air bubble generating means and the nozzle means so that the trace material is separated from the heterogeneous mixture of solids in the classification means, wherein the apparatus is supplied with the air and the water;

(b) introducing a soil sample suspected of containing the trace evidence into the feed column so that the air and water in the tubular conduit conveys the trace evidence to the classification means; and (c) detecting the trace evidence in the classification means.

11. In a method for the separation and classification of a heterogeneous mixture of solids having different specific gravities containing a trace material from a crime scene separable by means of a liquid and air classification which comprises:

(a) providing an elutriation apparatus including a tubular conduit having a vertically oriented longitudinal axis and opposing upper and lower ends along the axis, wherein the lower end is closed;

a tubular transfer tube connected to and closing the upper end of the conduit and leading away from the axis of the conduit with an opening from the tube for removing a liquid flowing through the conduit and the tube;

air bubble generating means through the lower end of the conduit for providing a stream of air bubbles vertically through the conduit and parallel with the axis and out an air vent hole;

nozzle means mounted on the conduit and directed inwardly at an angle for introducing at least one stream of the liquid inside the tubular conduit adjacent to the air bubble generating means such that the stream is directed inwardly around the axis of the conduit;

classification means adjacent to the opening from the tube for collecting the trace material separated from the heterogeneous mixture; and a feed column for introducing the heterogeneous mixture of solids into the tubular conduit connected to the tubular conduit intermediate the ends to feed the material into the streams from air bubble generating means and the liquid nozzle means so that the trace material is separated from the heterogeneous mixture of solids in the classification means;

(b) placing a supply of said heterogeneous mixture in the tubular conduit through the feed column;

(c) elutriating some of the trace material by introducing air bubbles through the lower end of the tubular conduit flowing the liquid through the nozzles through the conduit and transfer tube and into the classification means and collecting the remains of the solids in the lower end of the conduit;

(d) collecting the trace material from the classification means; and (e) separating the solids from the lower end of the conduit and removing any trace material remaining in the solids.

12. The method of claim 11 wherein the feed column has a funnel.

13. The method of claim 7 wherein after the flushing in step (e) a drain plug in the feed column is removed to allow part of the water to drain from the tubular conduit and feed column.

14. The method of claim 11 wherein the feed column is flushed with water to remove any trace material to the classification means and wherein a drain plug is provided in the feed tube which is removed to reduce the water in the tubular conduit and feed column.

15. The method of claim 11 wherein air is introduced into the feed tube after flushing of the feed column with the classification means removed and the water is collected for examination for trace material.

16. The method of claim 7 wherein air is introduced into the feed tube after the flushing of the feed column with the classification means removed and the water collected for examination for trace material.

* * * * *

UNITED STATES PATENT AND TRADEMARK OFFICE

CERTIFICATE OF CORRECTION

PATENT NO. : 6,164,456

DATED : December 26, 2000

INVENTOR(S) : Alvin J.M. Smucker, et al.

It is certified that error appears in the above-identified patent and that said Letters Patent is hereby corrected as shown below:

Column 8, line 13, "(n-4)" should be -(n=4)-.

Column 11, line 44 (Claim 7), "[materials]" should be deleted.

Signed and Sealed this

Eighth Day of May, 2001

*Attest:*

Nicholas P. Godici

NICHOLAS P. GODICI

*Attesting Officer*

*Acting Director of the United States Patent and Trademark Office*